US006232923B1

(12) United States Patent
Guinn et al.

(10) Patent No.: US 6,232,923 B1
(45) Date of Patent: May 15, 2001

(54) PATCH ANTENNA CONSTRUCTION

(75) Inventors: Keith V. Guinn, Basking Ridge; George John Shevchuk, Old Bridge; Yiu-Huen Wong, Summit, all of NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/467,664

(22) Filed: Nov. 11, 1999

(51) Int. Cl.[7] ..... H01Q 1/38
(52) U.S. Cl. ..... 343/700 MS; 343/846
(58) Field of Search ..... 343/700 MS, 846, 343/849, 848, 829; H01Q 1/38

(56) References Cited

U.S. PATENT DOCUMENTS 4,806,941 * 2/1989 Knochel et al. ..... 343/700 MS
6,049,314 * 4/2000 Munson ..... 343/700 MS
6,072,434 * 6/2000 Papatheodorou ..... 343/702

* cited by examiner

*Primary Examiner*—Hoanganh Le
(74) *Attorney, Agent, or Firm*—Darby & Darby

(57) ABSTRACT

The conductive layers corresponding to a patch antenna are formed on a single substrate, as by printing a conductive ink. The substrate is in the form of an elongated, non-conductive, flexible sheet with the consecutive antenna layers printed thereon side-by-side. The layers of the antenna can then be brought into superposed alignment by appropriate folding of the sheet. The non-conductive rectangles can be maintained in spaced alignment to the cut-outs by placing a porous non-conductive block of spacing material therebetween. In a preferred embodiment the assembled structure has the various layers bonded together.

15 Claims, 2 Drawing Sheets

PATCH ANTENNA CONSTRUCTION

FIELD OF THE INVENTION

The present invention relates generally to antennas and, more particularly, concerns patch antennas which have a multi-layered construction.

BACKGROUND OF THE INVENTION

Patch antennas in common use today are typically constructed of three flat, conductive layers in superpose alignment. The first layer typically has a plurality of spaced, conductive, rectangular patches formed on a surface. The second layer is typically a solid conductive layer with a cut-out slot that underlying each rectangular patch of the first layer. The third layer has an arrangement of conductive feed traces which underlie the cut-outs in the second layer.

Conventional patch antennas are constructed by forming the slot (second) and feed (third) layers on a conventional, two-layered printed circuit board. The first layer, with the rectangular metallic sections, is then positioned at a distance above the circuit board through the use of mechanical standoffs, or the like. The expense of the printed circuit board, the patch assembly with the rectangular sections, and the standoffs makes the patch antenna a relatively high cost item.

It is an object of the present invention to provide a patch antenna structure which is relatively inexpensive, yet is able to maintain the accuracy required in the positioning of the components of each of the layers of the antenna and the relative positioning of the layers.

SUMMARY OF THE INVENTION

In accordance with the present invention, all of the conductive layers corresponding to a patch antenna are formed on a single substrate, as by printing a conductive ink. Preferably, the substrate is in the form of an elongated, non-conductive, flexible sheet with the consecutive antenna layers printed thereon side-by-side. The layers of the antenna can then be brought into superposed alignment by appropriate folding of the sheet. The conductive patches can be maintained in spaced alignment to the cut-outs by placing a porous non-conductive block or frame of spacing material therebetween. In a preferred embodiment the assembled structure has the various layers bonded together.

BRIEF DESCRIPTION OF THE DRAWINGS

The foregoing brief description, as well as other objects, features, and advantages of the present invention will be understood more completely from the following detailed description of presently preferred, but nonetheless illustrative, embodiments thereof, with reference being had to the accompanying drawings in which.

DETAILED DESCRIPTION OF THE PREFERRED EMBODIMENT

Figure 1:
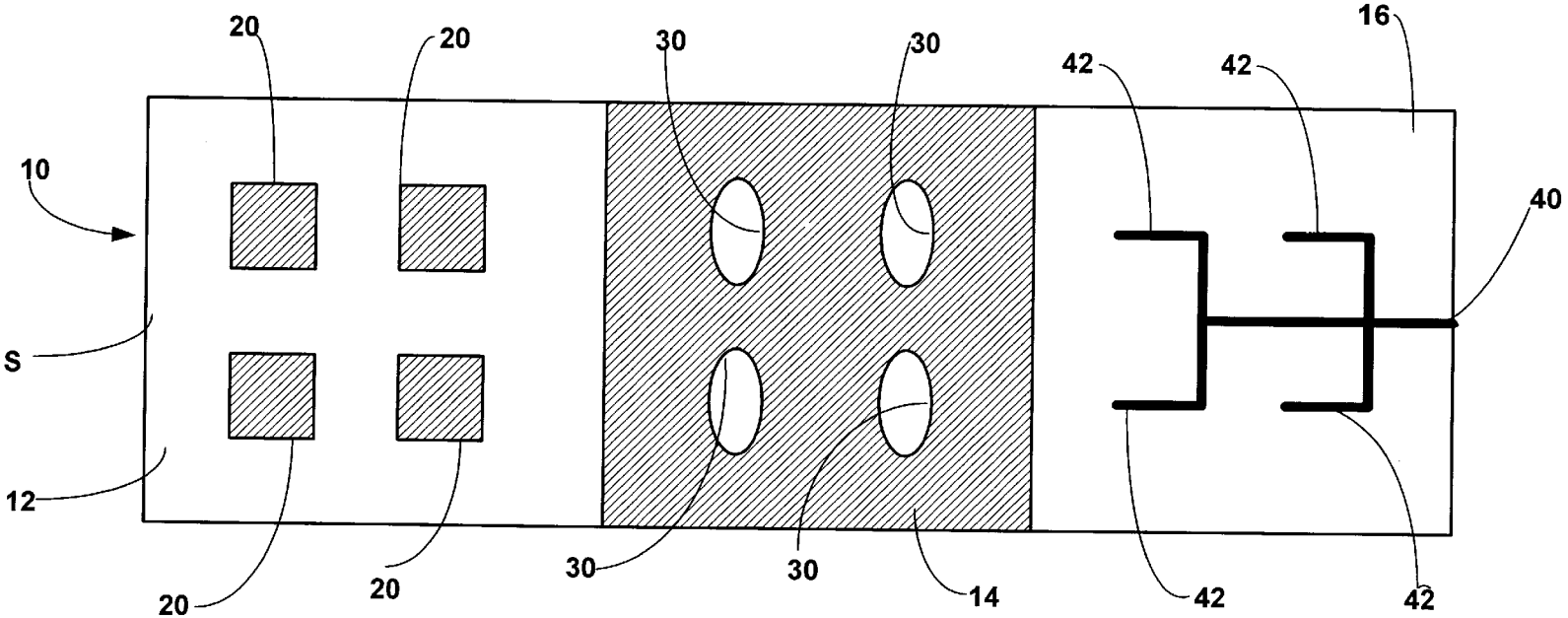
FIG. 1 is a plan view of a preferred embodiment of a structure for forming a patch antenna in accordance with the present invention.
Figure 3:
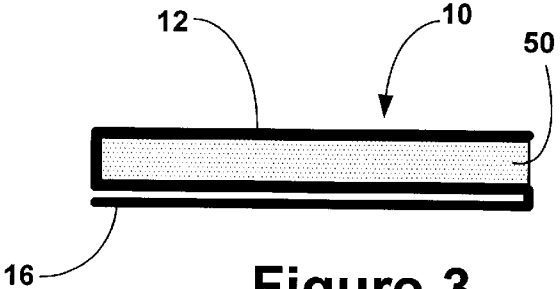
FIG. 3 is a side view similar to FIG. 2 showing the structure after the area containing the patches has been folded on top of the spacer.

Turning now to the drawings, FIG. 1 is a plan view illustrating a preferred embodiment of a structure 10 used to create a three-layered patch antenna in accordance with the present invention. The antenna is formed on a substrate S made of a flexible, non-conductive sheet material such as a modified polyphenylene oxide available form GE Plastics under the trademark NORYL. Three separate conductive regions 12, 14, 16 are then formed on the surface of the substrate, as by printing with a conductive ink. Those skilled in the art will appreciate that other methods may be used to form the conductive sections and accordingly, those sections will be referred to hereafter as simply "metalized."

In the preferred embodiment, four rectangular metalized, patch regions 20 are provided in area 12 in a rectangular arrangement, but those skilled in the art will appreciate that the patches can have any other shape and can be in any other arrangement. The second metalized area 14 is fully metalized except for four cut-out slots 30 formed in a rectangular arrangement and positioned so that each will underlie a respective rectangle 20 when section 12 is folded over section 14. The third metalized section 16 has an arrangement of traces 40 with the trace portions 42 being positioned so that each will underlie a respective one of the slots 30 when section 16 is folded under section 14.

Figure 2:
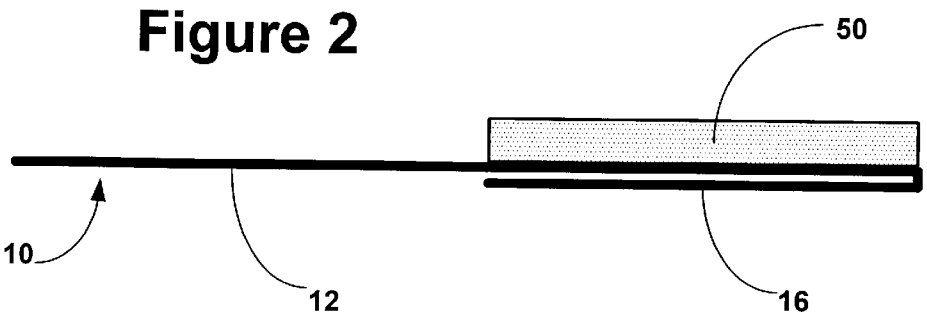
FIG. 2 is side view showing the structure of FIG. 1 after the area containing the traces has been folded under, with a spacer placed on top of the central area.

In constructing the patch antenna, section 16 is folded under section 14 and bonded into position, as with an adhesive, as shown in FIG. 2. A spacer block or frame 50 is then placed upon layer 14. Section 12 is then folded over spacer block 50, and they may also be bonded in position. It will be appreciated that the positioning of rectangles 20 on section 12 has to be such as to take into account the thickness of spacer block 50. Spacer block 50 can be made of any open, light weight, non-conductive material and should consist mostly of air.

Figure 4:
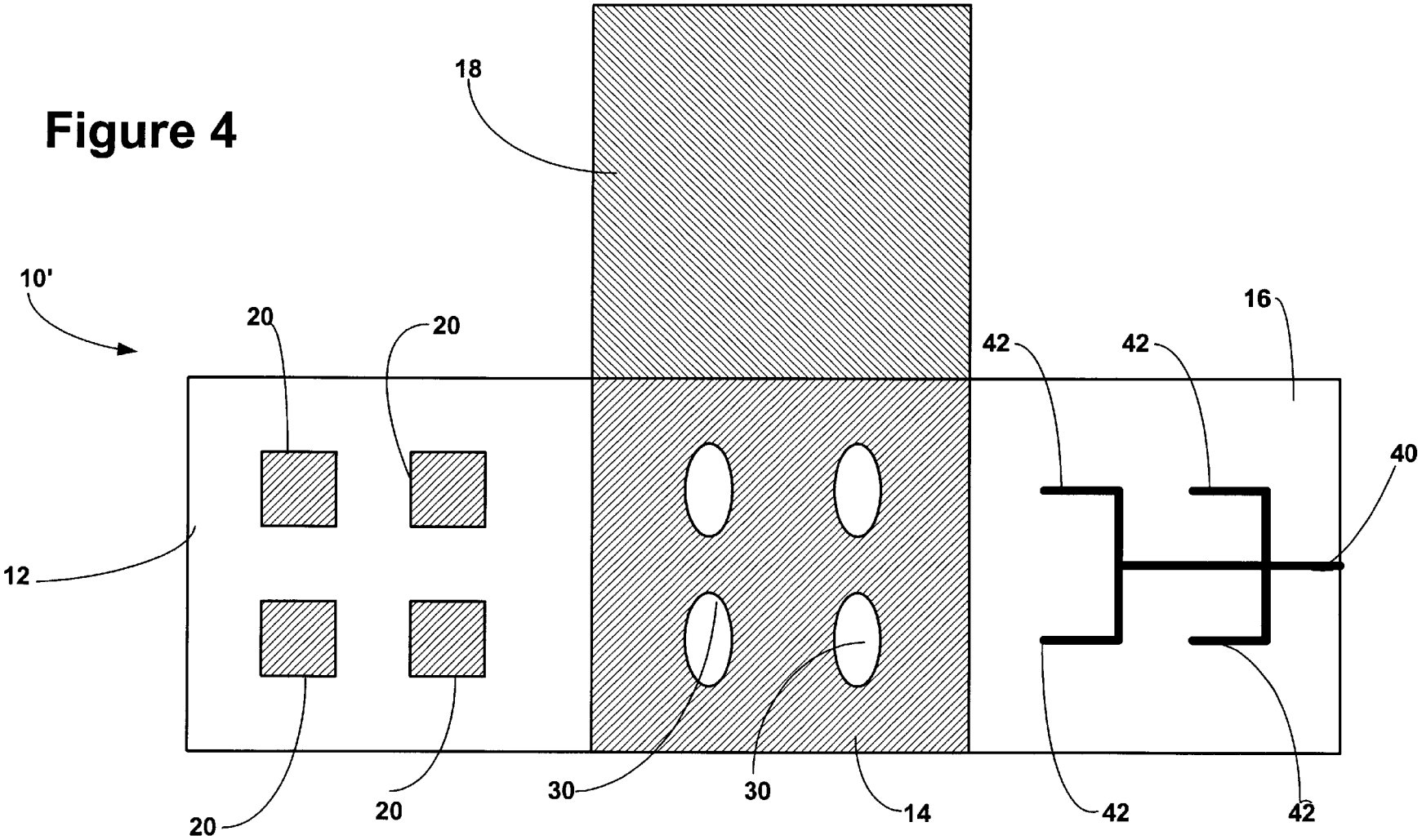
FIG. 4 is a plan view of an alternate embodiment of a structure for forming a patch antenna in accordance with the present invention.

FIG. 4 illustrates an alternate embodiment 10' of a patch antenna in accordance with the present invention. Antenna 10' is identical to antenna 10 in most respects, and corresponding components have been identified by the same reference characters. The major difference in antenna 10' is that a fourth layer 18 has been provided in an upwardly extending region of the substrate S. Region 18 is shown as fully metalized for distinguishing it visually. However it could be configured in any way desired to achieve unique antenna characteristics. Region 18 and additional regions could also be positioned in-line with the other regions, for use as needed. It will also be appreciated that, in assembling the antenna, region 18 could be folded under region 16, over region 12, or between any other two regions, as necessary to achieve specific characteristics. It will also be appreciated that the three layer antenna could have been formed from an L-shaped sheet, instead of a straight one.

Although preferred embodiments of the invention have been disclosed for illustrative purposes, those skilled in the art will appreciate that many additions, modifications and substitutions are possible, without departing from the scope and spirit of the invention as defined by the accompanying claims.

We claim:

1. A structure for forming a patch antenna, comprising:

a substrate made of a flexible, non-conductive sheet material;

at least three regions formed on a surface of said substrate so that the regions will align in superposed, layered arrangement when the substrate is folded in a predefined manner, the regions having conductive coatings formed in predetermined patterns which produce the layers of the patch antenna when the substrate is folded in the predefined manner.

2. The structure of claim 1 comprising more than three regions.

3. The structure of claim 1 wherein said substrate is folded in the predetermined manner, thereby forming a patch antenna.

4. The structure of claim 3. wherein the substrate is folded so that the first and third regions are superposed over opposite surfaces of the substrate.

5. The structure of claim 3 further comprising a block of non-conductive material interposed between said first and second regions.

6. A structure for forming a patch antenna, comprising:

a substrate made of a flexible, non-conductive sheet material;

at least three regions formed on a surface of said substrate so that the regions will align in superposed arrangement when the substrate is folded in a predefined manner, the regions having conductive coatings formed in predetermined patterns which produce the layers of the patch antenna when the substrate is folded in the predefined manner;

said structure having three regions, including:

a first region including a plurality of conductive patches in spaced arrangement;

a second region adjacent to the first region having a fully conductive surface with an opening therein positioned to coincide with each of said conductive patches when said substrate is folded in the predefined manner;

a third region adjacent to the second region and having a plurality of conductive traces thereon, at least one of which is positioned to coincide with one of said openings when said substrate is folded in the predefined manner.

7. The structure of claim 6 comprising four rectangular patches in a rectangular arrangement.

8. The structure of claim 7 comprising more than three regions.

9. The structure of claim 8 wherein said substrate is folded in the predetermined manner, thereby forming a patch antenna.

10. The structure of claim 9 wherein the substrate is folded so that the first and third regions are superposed over opposite surfaces of the substrate.

11. The structure of claim 9 further comprising a block of non-conductive material interposed between said first and second regions.

12. The structure of claim 6 comprising more than three regions.

13. The structure of claim 6 wherein said substrate is folded in the predetermined manner, thereby forming a patch antenna.

14. The structure of claim 13 wherein the substrate is folded so that the first and third regions are superposed over opposite surfaces of the substrate.

15. The structure of claim 13 further comprising a block of non-conductive material interposed between said first and second regions.

* * * * *